United States Patent [19]

Michelson et al.

[11] Patent Number: 4,839,684

[45] Date of Patent: Jun. 13, 1989

[54] PHOTOGRAPHIC TRAY AGITATOR

[76] Inventors: Randi J. Michelson, 3235 Parkside Pl.-1K, Bronx, N.Y. 10467; Mercedes B. Leonard, 430 E. 65th St. #2E, New York, N.Y. 10021

[21] Appl. No.: 235,203

[22] Filed: Aug. 23, 1988

[51] Int. Cl.[4] ..... G03D 3/04

[52] U.S. Cl. ..... 354/327; 366/211

[58] Field of Search ..... 354/327, 328, 331; 366/239, 211

[56] References Cited

U.S. PATENT DOCUMENTS

| | | | |
|---|---|---|---|
| 2,480,236 | 8/1949 | Gay | 354/328 |
| 2,682,213 | 6/1954 | Shapiro | 354/328 |
| 3,998,434 | 12/1976 | Gaynor | 354/327 |
| 4,026,531 | 5/1977 | Luchsinger et al. | 366/211 |
| 4,255,039 | 3/1981 | Hope et al. | 354/328 |
| 4,362,377 | 12/1982 | Yoshida et al. | 354/328 |
| 4,423,945 | 1/1984 | Preston et al. | 354/328 |

*Primary Examiner*—A. A. Mathews

*Attorney, Agent, or Firm*—Leon Gilden

[57] ABSTRACT

A photographic tray agitator is set forth wherein an oscillating arm is cycled to maintain a photographic tray of chemicals constantly agitated for enhancing photographic development. A coil spring is wound within a housing to operate a clockwork that effects a cammed oscillation of an extending arm wherein the arm is adjustable in time of pivotment by means of a first friction adjustment bearing directly on the arm and a second friction adjustment adjusting tension on a drive gear of the clockwork mechanism.

6 Claims, 1 Drawing Sheet

PHOTOGRAPHIC TRAY AGITATOR

BACKGROUND OF THE INVENTION

1. Field of the Invention

The invention relates to photography development, and particularly pertains to a new and improved photographic tray agitator that oscillates a photographic development tray in a predetermined time sequence.

2. Description of the Prior Art

The use of photographic agitation equipment is well known in the prior art. The devices utilized in the prior art have generally been of a complex and elaborate structure, as opposed to the instant invention setting forth a portable self-contained agitating unit that may be positioned as desired. For example, U.S. Pat. No. 2,480,236 to Gay sets forth a photographic agitator utilizing an oscillating lever powered by a driving motor through an elaborate association of levers to simultaneously agitate a plurality of trays through a bell-crank arrangement. The Gay patent is of limited adaptability as opposed to the instant invention that may be portably positioned as desired.

U.S. Pat No. 2,682,213 to Shapiro sets forth a photographic washing and agitating apparatus utilizing electric drive motor coupled to an eccentric for rocking the frame on a support that is supportingly carrying a photographic tray thereon.

U.S. Pat. No. 4,255,039 to Hope utilizes a series of rollers to transport photographic paper and film therethrough through a succession of processing procedures in association with tanks containing liquid for processing the respective paper and film wherein the respective liquid within tanks are agitated simultaneously of the operation of the transport roller system.

U.S. Pat. No. 4,362,377 to Yoshida utilizes a film transport mechanism to transport a continuous film through a developing solution in a tank wherein a pulse counter counts pulses generated from a pulse generator to count the time required for film treatment in the tank.

U.S. Pat. No. 4,423,945 to Preston sets forth a means to provide a series of pulses to avoid passage of light into said film processing container during movement of said film during the securement of film within the tank wherein agitation is effected as a result of movement of a film holding means within the tank.

As such, it may be appreciated that there continues to exist a need for a new and improved photographic tray agitator that may be conveniently positioned as desired by providing a self-powered compact agitating unit that is adjustable for cycling of photographic solution within a film holding tank.

SUMMARY OF THE INVENTION

In view of the foregoing disadvantages inherent in the known types of photographic tray agitators now present in the prior art, the present invention provides a photographic tray agitator wherein the same may be compactly stored during periods of non-use and may further easily and efficiently be arranged and oriented in use with a photographic development tray and adjusted for periodic agitation of the tray. As such, the general purpose of the present invention, which will be described subsequently in greater detail, is to provide a new and improved photographic tray agitator which has all the advantages of the prior art photographic tray agitators and none of the disadvantages.

To attain this, the present invention comprises a photographic tray agitator employing a self-contained mechanical spring for imparting stored energy to a plurality of gears to actuate an eccentric to periodically pivot and oscillate an extending arm extending orthogonally to a housing containing the aforenoted components to periodically agitate a photographic tray. The apparatus employs a plurality of adjustment means to provide a four-second cycle of oscillation.

My invention resides not in any one of these features per se, but rather in the particular combination of all of them herein disclosed and claimed and it is distinguised from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved photographic tray agitator which has all the advantages of the prior art photographic tray agitators and none of the disadvantages.

It is another object of the present invention to provide a new and improved photographic tray agitator which may be easily and efficiently manufactured and marketed.

It is a further object of the present invention to provide a new and improved photographic tray agitator which is of a durable and reliable construction.

An even further object of the present invention is to provide a new and improved photographic tray agitator which is susceptible of a low cost of manufacture with regard to both materials and labor, and which accordingly is then susceptible of low prices of sales to the consuming public, thereby making such photographic tray agitators economically available to the buying public.

Still yet another object of the present invention is to provide a new and improved photographic tray agitators which provides in the apparatuses, and methods of the prior art some of the advantages thereof, while simultaneously overcoming some of the disadvantages normally associated therewith.

Still another object of the present invention is to provide a new and improved photographic tray agitator that utilizes a plurality of adjustment means to maintain a four-second cycle of a photographic tray apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
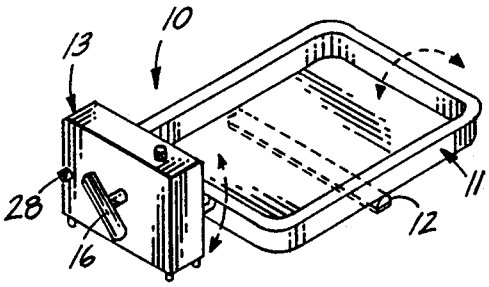
FIG. 1 is an isometric illustration of the instant invention.
Figure 2:
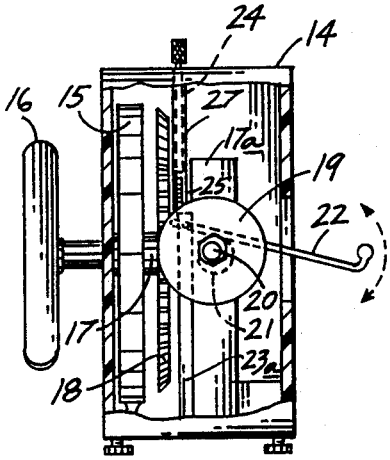
FIG. 2 is an orthographic side view of the instant invention in a partial cutaway view illustrating the internal mechanism.
Figure 3:
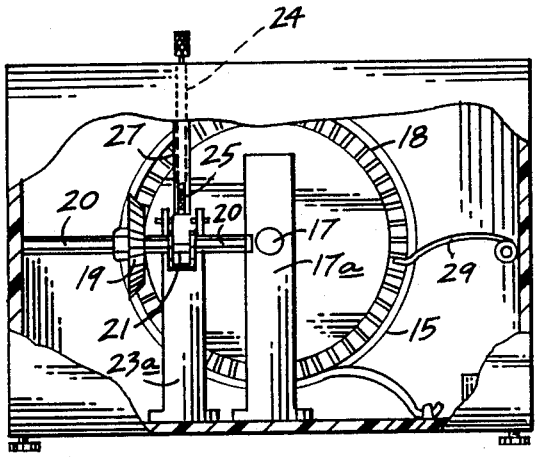
FIG. 3 is a front orthographic view of the instant invention in partial cutaway view of the instant invention illustrating the various components and their relationship therein.
Figure 4:
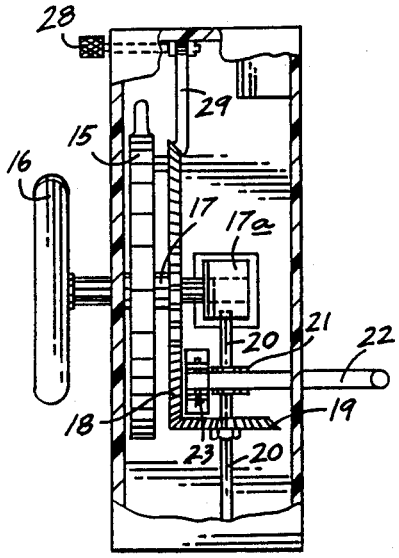
FIG. 4 is a top orthographic view of the instant invention in partial cutaway view illustrating the various components therein.
Figure 5:
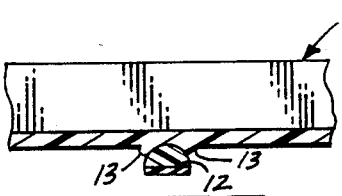
FIG. 5 is a somewhat enlarged cross-sectional orthogonal view of the fulcrum strip and development tray of the instant invention.

With reference now to the drawings, and in particular to FIGS. 1 to 7 thereof, a new and improved photographic tray agitator embodying the principles and concepts of the present invention and generally designated by the reference numeral 10 will be described.

More specifically, it will be noted that the photographic tray agitator apparatus 10 essentially comprises a photographic tray 11 mounted on an elongate fulcrum 12 wherein the fulcrum 12 is maintained in alignment relative to the photographic tray 11 within an arcuate downwardly depending saddle 13 integrally formed to and projecting outwardly of the lower surface of the photographic tray 11.

The housing 14 of the photographic tray agitator apparatus 10 includes an energy releasing helical spring 15 operatively secured to a wind-up handle 16 projecting orthogonally outwardly of the rear face of the housing 14. A first drive shaft 17 is associated with the spring 15 to receive rotational actuation through the release of energy of the spring 15 wherein the drive shaft 17 is secured to the spring 15 at one end and to support post **17*a* at the other end thereof. A drive bevel gear 18 is integrally secured to the first drive shaft 17 and is orthogonally oriented to a driven bevel gear 19 orthogonally thereto. The driven bevel gear 19 is integrally secured to an axial second drive shaft 20. The drive shaft 20 is secured to an end of the housing 14 and to the support post 17*a* at its other end. Integrally formed onto the second drive shaft 20 is a cam 21 underlying an "L" shaped pivot arm 22. The "L" shaped pivot arm 22 is rearwardly secured at rear pivot connection 23 formed on an upwardly extending second support post 23*a*. To enable adjustment of contact pressure of the "L" shaped pivot arm 22 on the cam 21, a first adjustment shaft 24 downwardly extends from an upper surface of the housing 14 and employs a spring 25 and a pressure foot 26 thereunder directly imparting pressure on the pivot arm 22 between the cam 21 and the rear pivot connection 23. This first adjustment means enables a first degree of fine adjustment of the mechanism and will accordingly retard or advance the speed of oscillation of the pivot arm 22. The confinement tube 27 extends axially about the first adjustment shaft 24 to maintain the pressure foot 26 and spring 25** in alignment.

A second adjustment shaft 28 extending outwardly of the rear face of the housing 14 is operatively secured to a pressure spring 29 formed with an engagement tip to engage the drive bevel gear 18. This second adjustment means further allows the adjustment of the mechanism for providing a determined oscillation cycle that is desirably of a four-second duration to provide a two-second upward and a subsequent two-second downward pivotal movement of the pivotal arm 22.

Figure 6:
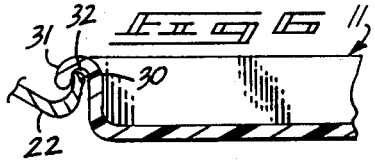
FIG. 6 is a somewhat enlarged orthographic cross-sectional view of the photographic development tray and associated pivot arm.
Figure 7:
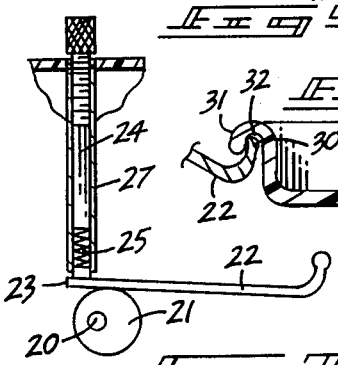
FIG. 7 is an orthographic view of the cam roller and pivot arm in association with a first adjustment means of the instant invention.

The "L" shaped pivot arm 22 is formed with a bulbous tip 30, as illustrated in FIG. 6, that engages and projects within an internal cavity 32 of a slightly greater cross-sectional dimension than the tip 30, but captures the tip 30 within the downwardly extending resilient lip 31 to capture the tip 30 therein. Initially the tip 30 is forced past the gap formed by the lip 31 and the side wall of the photographic tray 11 to secure the tip therein.

In this manner the photographic tray is oscillated, as noted in a four-second cycle, to agitate the chemicals typically utilized in a photographic development procedure within the tray 11.

As to the manner of usage and operation of the instant invention, the same should be apparent from the above description. Accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A photographic tray apparatus comprising, a pivotally mounted frame means for containing a photographic washing solution, and a housing including an energy releasing spring, and a wind-up handle operatively secured to said spring and extending outwardly of said housing, and a first drive gear operatively associated with said spring by a first drive shaft to receive rotational energy from said spring, and a driven gear connected to said drive gear and formed with an elongate second axially extending drive shaft, and a cam rotatable connected to said second drive shaft, and an "L" shaped pivot arm means pivotally mounted rearwardly of said second drive shaft for maintaining contact with said cam, and said pivot arm extending outwardly of said housing in engagement with said tray for oscillatingly moving said tray in a predetermined cycle.

2. A photographic tray agitator apparatus as set forth in claim 1 wherein said pivotally mounted tray includes a downwardly extending arcuate saddle, and an elongate fulcrum mounted in said saddle for maintaining said tray in a fixed position relative to said housing.

3. A photographic tray agitator apparatus as set forth in claim 2 wherein said tray is formed with a downwardly extending perimeter lip, and said "L" shaped pivot arm includes a bulbous tip of a diameter greater than a distance between said lip and a side wall of said tray for capturing said bulbous tip within cavity defined within said downwardly extending lip and a side wall of said tray.

4. A photographic tray agitator apparatus as set forth in claim 3 wherein a first adjustment means is provided for adjusting pressure of said "L" shaped pivot arm relative to said cam including a shaft extending outwardly of said housing to a position interiorly of said housing and including a resiliently biased pressure foot engaging said "L" shaped pivot arm between said cam and a pivot mounting that pivotally mounts said "L" shaped pivot arm rearwardly of said second drive shaft.

5. A photographic tray agitator apparatus as set forth in claim 4 wherein a second adjustment means includes a rotatable shaft to vary tension on a second spring wherein said second spring is formed with a tip in engagement with said drive gear wherein said second adjustment means is adjustable to vary the pressure of the spring in engagement of said drive gear.

6. A photographic tray agitator apparatus as set forth in claim 5 wherein said predetermined cycle is substantially four seconds to define a two-second upward and a two-second downward travel of said "L" shaped pivot arm.

* * * * *